US006164371A

United States Patent [19]

Bertilsson et al.

[11] Patent Number: 6,164,371

[45] Date of Patent: Dec. 26, 2000

[54] PLATE HEAT EXCHANGER FOR THREE HEAT EXCHANGING FLUIDS

[75] Inventors: Klas Bertilsson, Eslöv; Ralf Blomgren, Skanör; Ingvar Lindholm, Lund, all of Sweden; Claes Stenhede, Verona, Italy

[73] Assignee: Alfa Laval AB, Tumba, Sweden

[21] Appl. No.: 09/367,966

[22] PCT Filed: Feb. 12, 1998

[86] PCT No.: PCT/SE98/00244

§ 371 Date: Nov. 5, 1999

§ 102(e) Date: Nov. 5, 1999

[87] PCT Pub. No.: WO98/37373

PCT Pub. Date: Aug. 27, 1998

[30] Foreign Application Priority Data

Feb. 21, 1997 [SE] Sweden ..... 9700614

[51] Int. Cl.[7] ..... F28F 3/08

[52] U.S. Cl. ..... 165/140; 165/167

[58] Field of Search ..... 165/140, 167, 165/139

[56] References Cited

U.S. PATENT DOCUMENTS

| | | | |
|---|---|---|---|
| 448,521 | 3/1891 | Horner . | |
| 2,617,634 | 11/1952 | Jendrassik | 165/140 |
| 3,117,624 | 1/1964 | Wennerberg | 165/167 |
| 3,404,733 | 10/1968 | Pottharst, Jr. | 165/166 |
| 3,532,161 | 10/1970 | Lockel . | |
| 5,462,113 | 10/1995 | Wand | 165/167 |
| 5,924,484 | 7/1999 | Andersson et al. | 165/167 |

FOREIGN PATENT DOCUMENTS

| | | | |
|---|---|---|---|
| 2254290 | 10/1990 | Japan . | |
| 2254291 | 10/1990 | Japan . | |
| 473594 | 3/1992 | Japan | 165/140 |
| 504 799 | 4/1997 | Sweden . | |

*Primary Examiner*—Leonard Leo
*Attorney, Agent, or Firm*—Fish & Richardson, P.C.

[57] ABSTRACT

The present invention constitutes a plate heat exchanger for three heat exchanging fluids. The heat exchanger includes at least one core of plates with heat exchanging plates (1–4), at least two end plates (5) and inlets and outlets (6) for the heat exchanging fluids, each one of the heat exchanging plates (1–4) being provided with six port holes (11–16). The plate heat exchanger has port holes (11–16) that are pairwise aimed for the flowing through of the respective heat exchanging fluids where the port holes (11–16) in every such pair are situated on both sides of a heat transferring part in such a way that a straight line drawn between the centers of the port holes (11–16) divides the heat transferring part into two similar parts. The invention is also directed to a plate heat exchanger for refrigeration applications, in which the port holes (17, 18, 20, 21, 23, 23', 24, 24') for each one of the two fluids create at least two inlet channels through the core of plates which, for each one of the fluids, are in fluid communication with each other at a plurality of places along the inlet channels in such a way that the fluid, on its way from the one inlet channel to plate interspaces aimed therefor, is forced to pass through the other inlet channel.

15 Claims, 6 Drawing Sheets

PLATE HEAT EXCHANGER FOR THREE HEAT EXCHANGING FLUIDS

FIELD OF THE INVENTION

The present invention refers to a plate heat exchanger for three heat exchanging fluids which heat exchanger comprises at least one core of plates with heat exchanging plates, at least two end plates and inlets and outlets for the heat exchanging fluids. The invention also refers to a plate heat exchanger for refrigeration applications.

BACKGROUND OF THE INVENTION

Plate heat exchangers for three heat exchanging fluids have many potential fields of application. They may for example be used as evaporators for evaporation of refrigerants flowing in refrigeration systems. Such a refrigeration system normally includes a compressor, a condenser, an expansion valve and an evaporator. A plate heat exchanger used as an evaporator in a system of this kind often has heat exchanging plates that are welded or brazed together, but also packings may be used for sealing between the heat transferring plates.

U.S. Pat. No. 5,462,113 shows a plate heat exchanger with flow passages for three different fluids between the plates. The delivery of the three fluids to the core of plates is done in such a way that passages for the number one fluid are present on both sides of every passage for each one of the two remaining fluids. In a preferred embodiment the passages are created using two different kinds of plates. Good sealing between adjacent plates at the openings creating the inlet and outlet channels for the three fluids is created by designing the areas around the ports thereby defining a system with annular planar plateaus.

The design of the heat exchanger for three heat exchanging fluids gives the possibility of flexible operational solutions in connection with part load. The heat transfer is however not maximal effective.

SUMMARY OF THE INVENTION

The purpose of the invention is to create a more effective heat exchanger for three fluids. Thus the invention comprises a plate heat exchanger for three heat exchanging fluids, which heat exchanger comprises at least one core of plates with heat exchanging plates, at least two end plates and inlets and outlets for the heat exchanging fluids. Each one of the heat exchanging plates is provided with six port holes creating one inlet channel and one outlet channel through the core of plates for each one of the fluids and where the channels for one fluid are in fluid communication with every other plate interspace and the channels for each one of the remaining two fluids are in alternating fluid communication with every other one of the remaining plate interspaces.

Each one of the heat exchanging plates is provided with a central heat transfer part with one or several corrugations vertically extending within an area restricted by two parallel first and second planes, respectively, placed at a distance from each other, together creating the thickness restriction of the plate and both mainly in parallel with all plates in the core of plates as well as the end plates of the plate heat exchanger. The first plane is closer to a first end plate in one end of the heat exchanger than the second plane is and the second plane is closer to a second end plate in the other end of the heat exchanger than the first plane is.

The heat exchanging plates are present in four different forms of execution alternating within the core of plates.

Thereby a plate of the first form of execution is mounted close to a plate of a second form of execution and a plate of a fourth form of execution. A plate of the second form of execution is mounted close to a plate of a third form of execution and a plate of the first form of execution. A plate of the third form of execution is mounted close to a plate of the fourth form of execution and a plate of the second form of execution. Finally, a plate of the fourth form of execution is mounted close to a plate of the first form of execution and a plate of the third form of execution.

The port holes are pairwise aimed at the flowing through of the heat exchanging fluids respectively where the port holes in every such pair are situated on both sides of the heat transfer part in such a way that a straight line drawn between the centres of the port holes divides the heat transfer part into two alike parts.

Plates of the first form of execution have two first mainly circular port holes intended for the first fluid, each port hole of a first diameter and surrounded by a sealing area in the mentioned first plane for sealing against a sealing area around a port hole in a first one of the two closest nearby contacting plates in the core of plates, two second, mainly circular port holes intended for a second fluid, each port hole of a second diameter smaller than the first diameter and surrounded by a first sealing area in the mentioned second plane for sealing against a sealing area around a port hole in the second one of the two closest nearby contacting plates in the core of plates as well as a second sealing area situated outside the first sealing area in the mentioned first plane for sealing against a sealing area around a port hole in the mentioned first one of the two closest nearby contacting plates in the core of plates and two third, mainly circular port holes intended for a third fluid, of a third diameter and each one surrounded by a sealing area in the mentioned second plane for sealing against a sealing area around a port hole of the same size in the mentioned second one of the two closest nearby contacting plates in the core of plates.

Plates of the second form of execution have two first mainly circular port holes intended for the mentioned first fluid, each one of a first diameter and surrounded by a sealing area in the mentioned second plane for sealing against a sealing area around a port hole in a second one of the two closest nearby contacting plates in the core of plates, two second, mainly circular port holes intended for the mentioned second fluid, each one of a second diameter smaller than the first diameter and surrounded by a first sealing area in the mentioned first plane for sealing against a sealing area around a port hole in the first one of the two closest nearby contacting plates in the core of plates as well as a second sealing area, concentrically situated outside the first sealing area and in the mentioned second plane, for sealing against a sealing area around a port hole in the mentioned second one of the two closest nearby contacting plates in the core of plates and two third, mainly circular port holes intended for the mentioned third fluid, of a third diameter and each one surrounded by a sealing area in the mentioned first plane for sealing against a sealing area around a port hole of the same size in the mentioned first one of the two closest nearby contacting plates in the core of plates.

Plates of the third form of execution have two first mainly circular port holes intended for the mentioned second fluid and each one of a first diameter and surrounded by a sealing area in the mentioned first plane for sealing against a sealing area around a port hole in a first one of the two closest nearby contacting plates in the core of plates, the said first port hole with associated sealing areas being situated in such positions on the plate that correspond to the positions for the second port holes with associated sealing areas in the plates of the first form of execution, two second, mainly circular port holes intended for the mentioned first fluid and each one of a second diameter smaller than the first diameter and surrounded by a first sealing area in the mentioned second plane for sealing against a sealing area around a port hole in the second one of the two closest nearby contacting plates in the core of plates as well as a second sealing area concentrically situated outside the first sealing area and in the mentioned first plane for sealing against a sealing area around a port hole in the mentioned first one of the two closest nearby contacting plates in the core of plates and two third, mainly circular port holes intended for the mentioned third fluid and of a third diameter and each one surrounded by a sealing area in the mentioned second plane for sealing against a sealing area around a port hole of the same size in the mentioned second one of the two closest nearby contacting plates in the core of plates.

Plates of the fourth form of execution have two first, mainly circular port holes intended for the mentioned second fluid and each one of a first diameter and surrounded by a sealing area in the mentioned second plane for sealing against a sealing area around a port hole in a second one of the two closest nearby contacting plates in the core of plates, said first port hole with the associated sealing area being situated in such positions on the plate that correspond to the positions for the other port holes with their associated sealing areas in the plates of the second form of execution, two second, mainly circular port holes intended for the mentioned first fluid and each one of a second diameter, smaller than the first diameter, and surrounded by a first sealing area in the mentioned first plane for sealing against a sealing area around a port hole in the first one of the two closest nearby contacting plates in the core of plates as well as a second sealing area concentrically situated outside the first sealing area and in the mentioned second plane, for sealing against a sealing area around the port hole in the mentioned second one of the two closest nearby contacting plates in the core of plates and two third, mainly circular port holes intended for the mentioned third fluid and of a third diameter and each one surrounded by a sealing area in the mentioned first plane for sealing against a sealing area around a port hole of the same size in the mentioned first one of the two closest nearby contacting plates in the core of plates.

The present form of execution of the heat exchanger shows an effective exploitation of the heat transferring surfaces since two of the fluids cooperating in the heat exchange may flow diagonally over the plates in the plate interspaces. The fluids are hereby well spread over the width of the plates and the fluid channels in the plate interspaces are well utilised.

The invention also comprises a plate heat exchanger for refrigeration applications for three heat exchanging fluids which heat exchanger comprises at least one core of plates with heat exchanging plates, at least two end plates and inlets and outlets for the heat exchanging fluids. The heat exchanging plates are provided with port holes creating inlet channels and outlet channels through the core of plates for the fluids and where the channels for one fluid are in fluid communication with every other plate interspace and the channels for each one of the remaining two fluids are in alternating fluid communication with every other one of the remaining plate interspaces.

The heat exchanging plates each one is provided with one or several corrugations vertically extending within an area restricted by two parallel first and second planes, respectively, situated at a distance to each other and together creating the thickness restriction of the plate and which both are mainly in parallel with all plates in the core of plates as well as with the end plates of the plate heat exchanger whereby the first plane is closer to a first end plate in one end of the heat exchanger than the other plane is and the second plane is closer to a second end plate in the other end of the heat exchanger than the first plane is.

The heat exchanging plates are present in four different forms of execution alternating within the core of plates. A plate of a first form of execution is mounted close to a plate of a second form of execution and a plate of a fourth form of execution. A plate of the second form of execution is mounted close to a plate of a third form of execution and a plate of the first form of execution. A plate of the third form of execution is mounted close to a plate of the fourth form of execution and a plate of the second form of execution. Finally, a plate of the fourth form of execution is mounted close to a plate of the first form of execution and a plate of the third form of execution.

The port holes for each one of two of the fluids create at least two inlet channels through the core of plates which inlet channels, for each one of the fluids, are in fluid communication with each other at several places along the inlet channels in such a way that the fluid, on its way from one inlet channel to plate interspaces intended therefor, is forced to pass through the second inlet channel.

This form of execution of the heat exchanger shows an effective utilisation of the heat transferring surfaces since the two inlet channels for each one of the two fluids contribute to a particularly even distribution of these fluids to the plate interspaces intended for the respective fluids and that, as a consequence, the plate heat exchanger in this way becomes effective.

The characterizing matter for the present invention is clear from the following patent claims.

BRIEF DESCRIPTION OF THE DRAWINGS

The plate heat exchangers will now be described more in detail in connection with forms of execution of the invention and with reference to the accompanying drawings.

DETAILED DESCRIPTION

Figure 1:
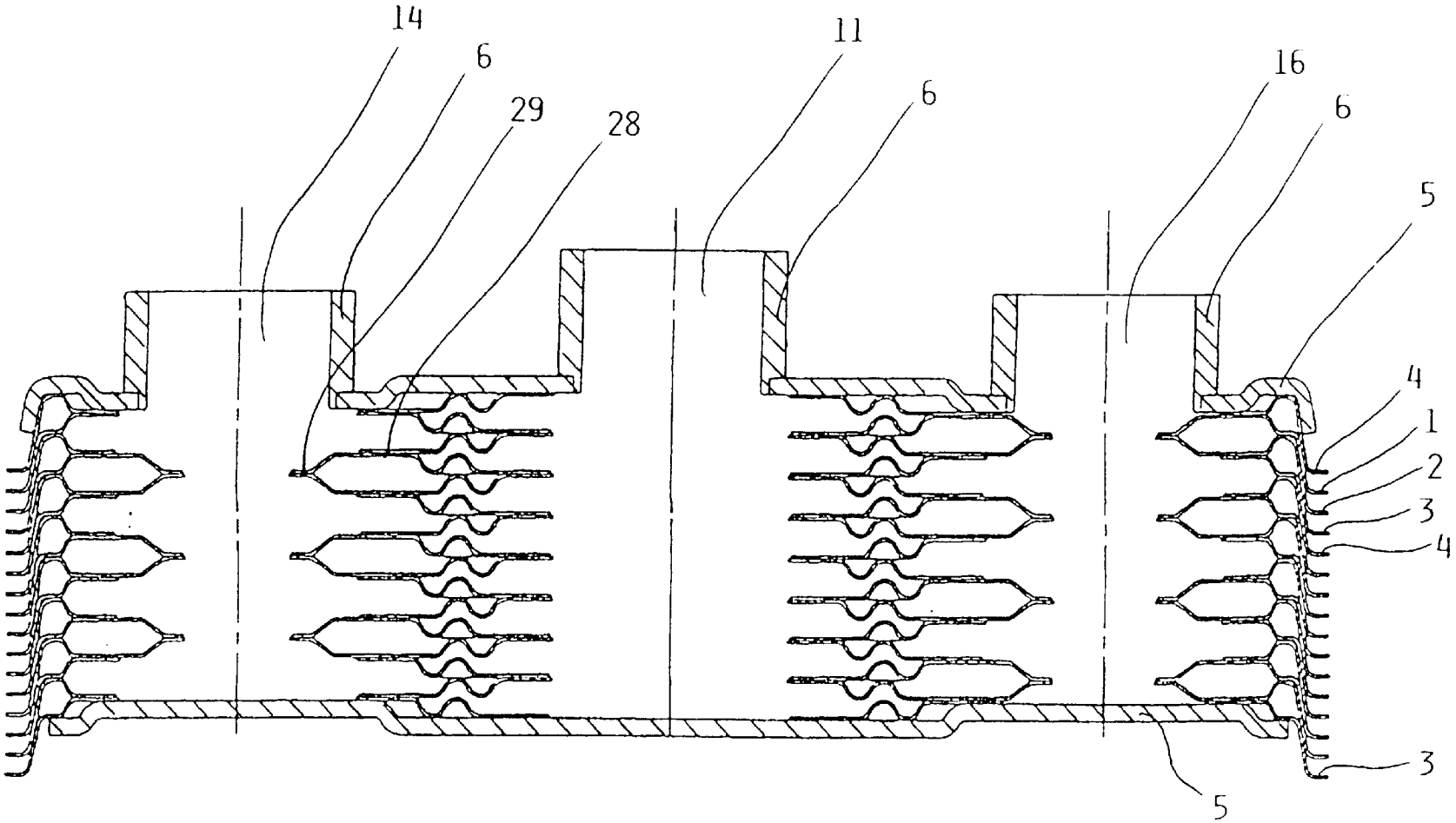
FIG. 1 shows a cross-section through a permanently joined plate heat exchanger according to the invention with heat exchanging plates, end plates and inlets and outlets for heat exchanging fluids.
Figure 2:
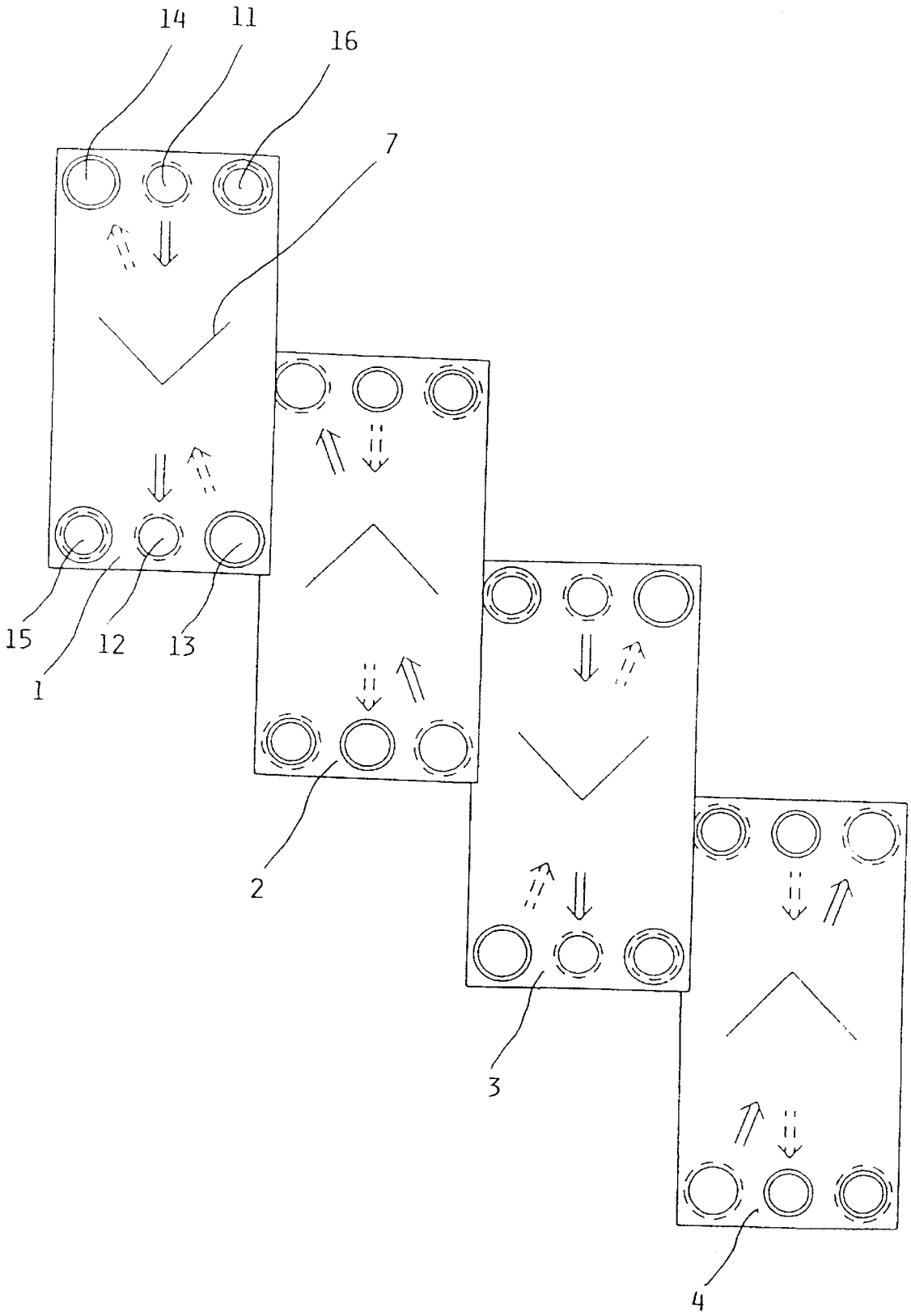
FIG. 2 shows in front view and in principal each one of the four different forms of execution of the heat exchanging plates in FIG. 1.

In FIG. 1 a cross-section is shown through a permanently joined plate heat exchanger with heat exchanging plates according to FIG. 2. The plates are of four different forms of execution 1–4. The core of plates, here consisting of sixteen plates, may of course be executed in a desirable dimension. The core of plates is completed in the ends with end plates 5 which are thicker than the heat exchanging plates. Six connections 6, here constituting inlets and outlets for the heat exchanging fluids, are present on one of the end plates 5.

The heat exchanging plates 1–4 are provided with port holes 11–16. In the core of plates the port holes are in line with each other in such a way that the port holes 11 create an inlet channel for a heat exchanging fluid, for example a fluid to be chilled, and the port holes 13 and 15, respectively, create inlet channels for the remaining two fluids, for example two refrigerants. In a corresponding way the port holes 12 create an outlet channel for one of the heat exchanging fluids, for example the fluid to be chilled, and the port holes 14 and 16, respectively, create outlet channels for the remaining two heat exchanging fluids, for example the refrigerants.

The plate heat exchanger is in a conventional manner equipped with sealing means between the heat exchanging plates. Hereby sealed flowing channels are created between the plates. One of the heat exchanging fluids, for example the above mentioned fluid to be chilled, may flow in every other plate interspace. The rest of the heat exchanging fluids, for example the above mentioned refrigerants, may flow alternating in every other of the remaining plate interspaces. Thus hereby, according to the present application, every plate interspace containing a heat exchanging fluid to be chilled gets on one side a plate interspace with one of the refrigerants and on the other side a plate interspace with the other refrigerant.

The heat exchanging plates 1–4 are provided with a corrugation pattern in the form of parallel ridges extending in such a way that ridges on adjacent heat transferring plates are crossing each other and bearing on each other in the plate interspaces. Every plate interspace functioning as a flow path for the fluid to be chilled is in connection with the inlet channel created by the port holes 11. In a corresponding way the plate interspaces functioning as flow paths for the respective refrigerant are in connection with the inlet channels created by the port holes 13 and 15, respectively. The outlet channel created by the port holes 12 is in connection with the plate interspace for one of the fluids, for example the fluid to be chilled, while the outlet channels created by the port holes 14 and 16, respectively, are in connection with the plate interspaces for the remaining two fluids, for example the refrigerant 1 and the refrigerant 2.

The fluid using the port holes/channels 11 and 12 flows mainly in parallel with the longsides of the plates or alternatively two of the side edges of the plates. The remaining two fluids, such as the refrigerants, mainly flow diagonally over the plates, i.e. the refrigerant 1 enters through the port hole/channel 13 and exits through the port hole/channel 14 while the refrigerant 2 enters through the port hole/channel 15 and exits through the port hole/channel 16. In FIG. 2 arrows show the main flow directions of the mediums, whereby a fully drawn arrow indicates flow on one side of the plate, on this side of the plate in FIG. 2, and a dashed arrow indicates flow on the other side of the plate, behind the plate in FIG. 2. The plates are commonly either mainly rectangular or square. Other forms are of course possible.

As may be seen in FIG. 2 the core of plates is built up of plates of four different forms of execution, where every other plate is of the same form of execution if the size and mood of execution of the port holes 13–16 are not considered. The inner circles in the port holes denotes port edges and the other concentric circles sealing edges and if these other concentric circles are fully drawn they are on one side of the plate, this side of the plate in FIG. 2, while they are on the other side of the plate, behind the plate in FIG. 2, if they are dashed.

The four ports 13–16 are from the beginning constructed with two concentric sealing areas each, one area in one plane of the corrugation pattern, on this side of the plate in FIG. 2, and one area in the other plane of the corrugation pattern, beyond the plate in FIG. 2. The radially outer one of these sealing areas is permanently joined with the corresponding area on a nearby contacting plate in order to create sealing between the port channels for the treating fluids and the plate interspaces for the treated fluid, see for example 28 in FIG. 1. The radially inner sealing area is in every other plate interspace for the treating fluids for the respective port channel 13–16 permanently joined with the corresponding surface on an nearby contacting plate in order to create a sealing between the two circuits for the treating fluids, see for example 29 in FIG. 1. A port channel used for one of the treating fluids is not to be in connection with a plate interspace for the other treating fluid. In the remaining plate interspaces for treating fluids that shall be in connection with the port channel in question, the inner sealing surface is instead cut away.

The port holes in the plates in FIG. 2 are pairwise of the same size and the holes in every such pair are situated on both sides of the heat transfer part in such a way that a straight line drawn between the centres of the holes divides the heat transfer part into two alike parts. A plate of the first form of execution has two first mainly circular port holes 13, 14, diagonally situated in the plate opposite to each other, each hole of a first diameter. Each hole is surrounded by the above mentioned outer sealing area for sealing against a sealing area around a port hole in a first one of the two closest nearby contacting plates in the core of plates. The sealing area is in a first plane which is closer to a first end plate in one end of the core of plates than the other plane is, where the first and the second planes together define the thickness restriction of the plate and where the first end plate is equipped with the connections 6 of the plate heat exchanger for the heat exchanging fluids.

Plates of the first form of execution further have two second mainly circular port holes 15, 16 intended for a second fluid and diagonally situated in the plate opposite to each other, each hole of a second diameter smaller than the first diameter and surrounded by a first sealing area in the mentioned second plane for sealing against a sealing area around a port hole in the second one of the two closest nearby contacting plates in the core of plates as well as a second sealing area concentrically situated outside the first one and in the mentioned first plane for sealing against a sealing area around a port hole in the mentioned first one of the two closest nearby contacting plates in the core of plates.

Further on, two third mainly circular port holes 11, 12 are present in plates of the first form of execution, intended for a third fluid and situated straight opposite to each other in the plate and with a third diameter and each one surrounded by a sealing area in the mentioned second plane. This sealing area seals against a sealing area around a port hole of the same size in the mentioned second one of the two closest nearby contacting plates in the core of plates.

Compared to plates of the first form of execution plates of the second form of execution shows the following differences:

The two first, mainly circular port holes for the mentioned first fluid shows a sealing area in the mentioned second plane for sealing against a sealing area around a port hole in the second of the two closest nearby contacting plates in the core of plates. The two other port holes, intended for the mentioned second fluid, show a first sealing area in the mentioned first plane as well as a second sealing area, concentrically situated outside the first one and in the mentioned second plane. Each one of the two third port holes intended for the mentioned third fluid is surrounded by a sealing surface in the mentioned first plane. The corrugations are oriented in another way.

Plates of the third form of execution according to FIG. 2 differ from those according to the first form of execution in the following manner:

The two first circular port holes diagonally situated opposite to each other and each one with a first diameter and surrounded by a sealing area in the mentioned first plane are situated in such positions on the plate that correspond to the positions for the second port holes with the corresponding sealing areas in plates of the first form of execution and are thus intended for the mentioned second fluid. The two second circular port holes diagonally situated opposite to each other and each one of a second diameter, smaller than the first diameter, and surrounded by a first sealing area in the mentioned second plane as well as a second sealing area concentrically situated outside the first one in the mentioned first plane are present in such positions on the plate that correspond to the positions for the first port holes with the corresponding sealing areas in plates of the first form of execution and are thus intended for the mentioned first fluid. For the two third circular port holes intended for the mentioned third fluid and situated opposite to each other, identity is present between the third and the first forms of execution.

Plates of the fourth form of execution according to FIG. 2 show in comparison with the above described second form of execution the following differences:

The two first circular port holes diagonally situated opposite to each other with sealing areas are present in such positions on the plate that correspond to the positions for the second port holes with corresponding sealing areas in the plates of the second form of execution and they are thus intended for the mentioned second fluid. The two second circular port holes diagonally situated opposite to each other and with sealing areas are present in such positions on the plate that correspond to the positions for the first port holes with their associated sealing areas in the plates of the second form of execution and they are thus intended for the mentioned first fluid. The two third circular port holes intended for the mentioned third fluid and positioned straight opposite to each other and each one surrounded by a sealing area show in plates of the fourth form of execution no differences in comparison with plates according to the second form of execution.

In the example of execution the mentioned second diameter is as large as the mentioned third diameter.

When the plates are to be used in an evaporator there is need for a specially designed inlet arrangement which guarantees an even distribution of the refrigerant to all refrigerant plate interspaces in question. Different types of distribution devices aimed for this may be seen in the FIGS. 3–5. Plates with distributors are usually turned in such a way that the distribution device is in the lower part of a core of plates with standing plates but also other modes of utilisation are known.

Figure 3A:
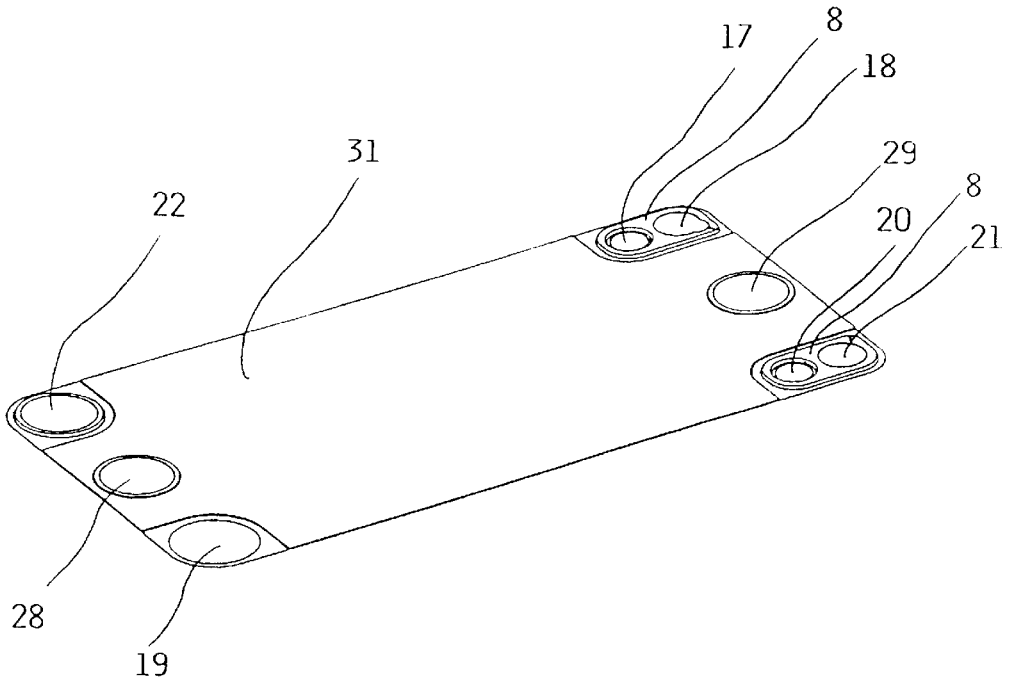
FIG. 3*a* shows in perspective view and in principal a form of execution of a heat exchanging plate for refrigeration applications where the plate is provided with distribution areas.
Figure 3B:
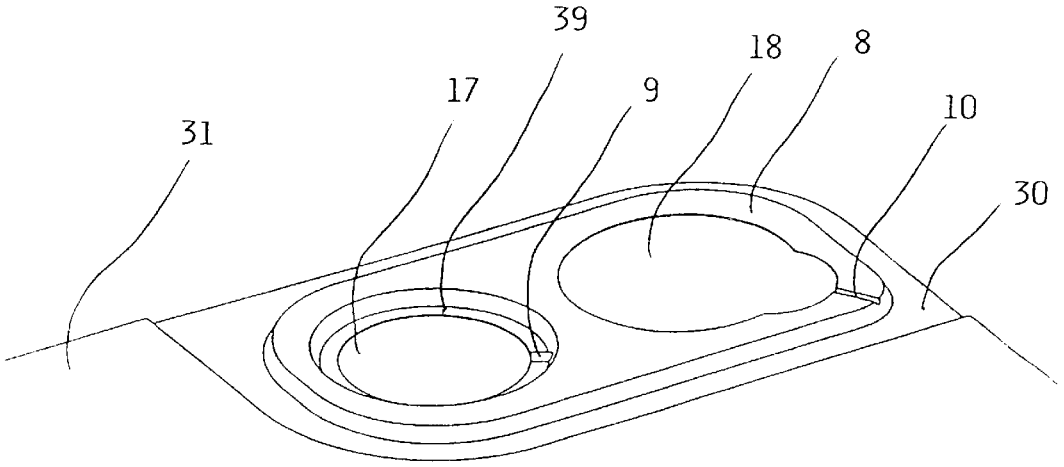
FIG. 3*b* shows in an enlargement in part a plate part with a distribution area according to FIG. 3*a*.
Figure 4A:
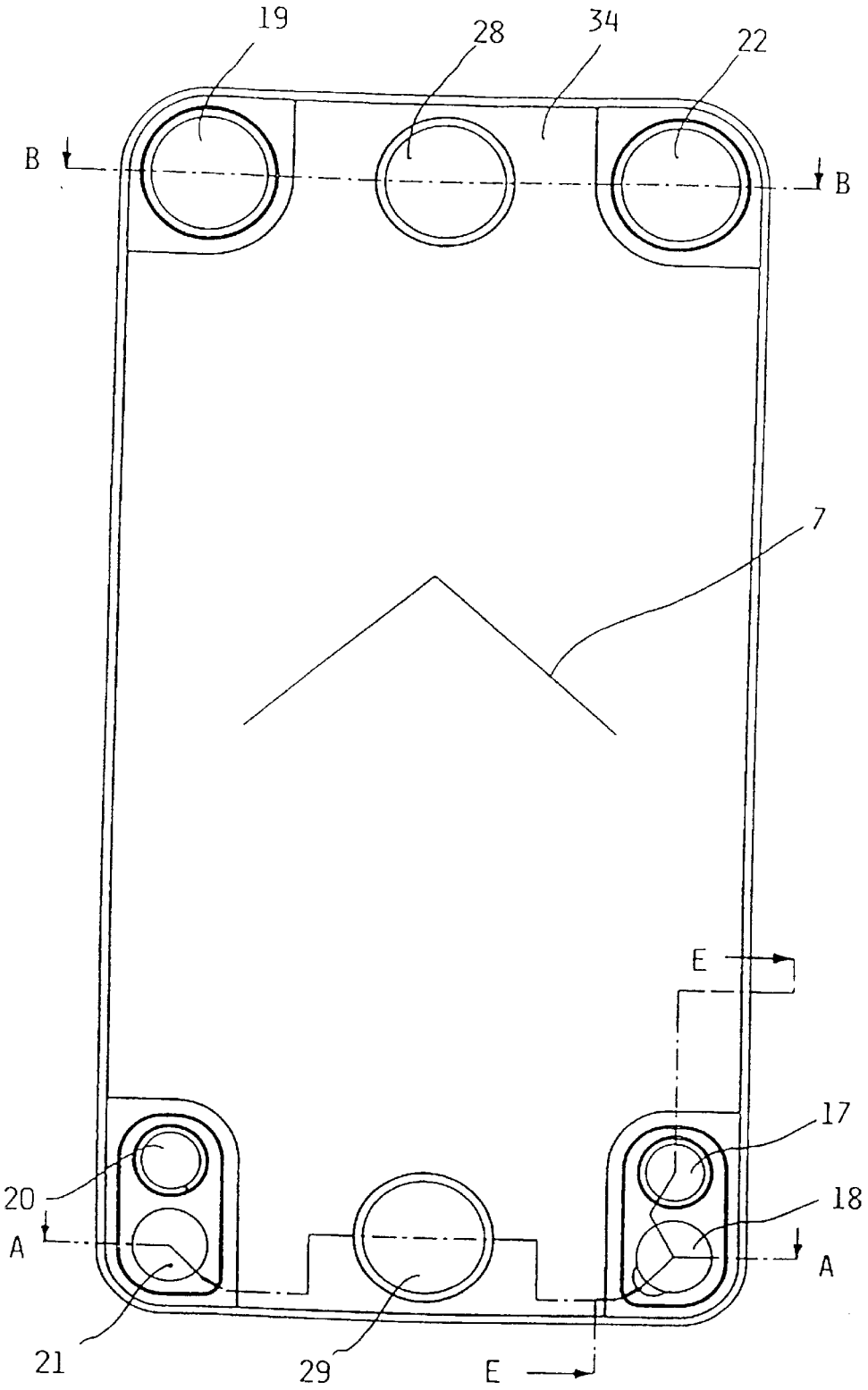
FIG. 4*a* shows the front plate in a core of plates built of plates according to FIG. 3.
Figure 4B:
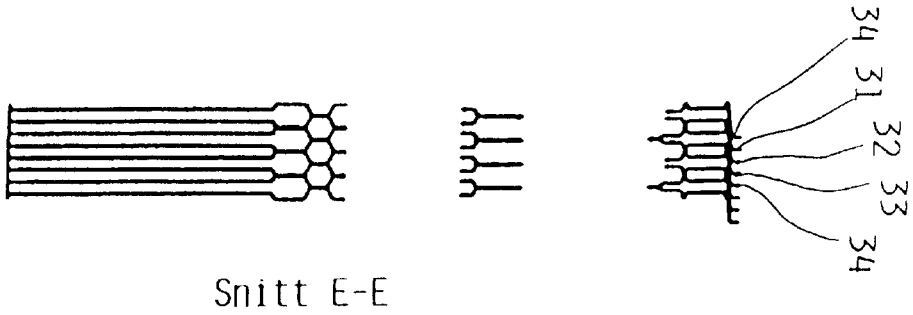
FIG. 4*b* shows a cross-section E—E through the core of plates in FIG. 4*a*.
Figure 4C:
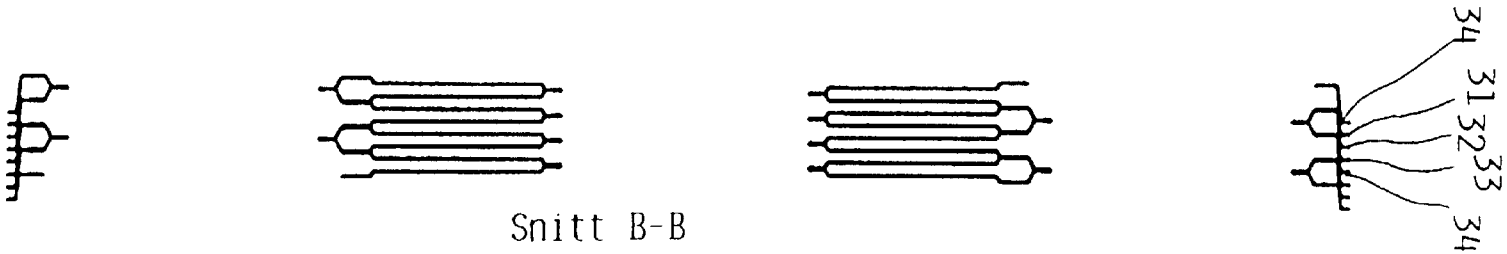
FIG. 4*c* shows a cross-section B—B through the core of plates in FIG. 4*a*.
Figure 4D:
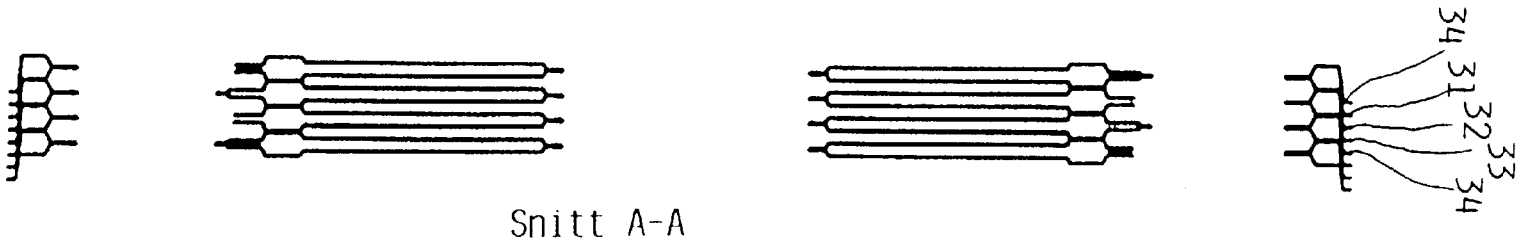
FIG. 4*d* shows a cross-section A—A through the core of plates in FIG. 4*a*.

In the core of plates with plates according to the FIGS. 3 and 4 and with the referral numbers concerning a plate observed from the front one of the refrigerants is, in connection with diagonal flow, led in through the port hole/channel 17, flows in recesses 9 out into the space restricted by the first distribution areas 8 for two adjacent plates and further on out into the port hole/channel 18 and is led out over the plates in the right plate interspaces via the recess 10. In a corresponding way the second refrigerant is led in through the port hole/channel 20, flows in the analogue of the recess 9 out into the space restricted by the first distribution areas 8 for two adjacent plates and further on out into the port hole/channel 21 and is led out over the plates in the right plate interspaces via the analogue of the recess 10. Only one of the recesses 10 is open on each plate. The first refrigerant leaves the heat exchanger through the port hole/channel 19 and the other one through the port hole/channel 22.

Also the plate type according to the FIGS. 3 and 4 is found in four forms of execution 31–34. Plates of the first form of execution have two first mainly circular port holes 19, 22 situated opposite to each other in the plate and along the same side edge of which holes the one port hole 19 is of a fourth diameter and surrounded by a sealing area in the mentioned second plane and the second port hole 22 is of a fifth diameter and surrounded by an inner sealing area in the mentioned first plane as well as a circumferentially outside the inner one situated outer sealing area in the mentioned second plane. The fifth diameter is smaller than the fourth one.

Further on, the first form of execution of the second plate type shows four second, mainly circular port holes 17, 18, 20, 21 pairwise situated opposite to each other in the plate and along the same side edge. Each one of two of the holes 17, 20 situated opposite to each other is of a sixth diameter and surrounded by a first sealing area 39 in the mentioned second plane as well as a second sealing area 8 circumferentially situated outside the first one and in the mentioned first plane and a third sealing area 30 circumferentially situated outside the second one and in the mentioned second plane. Each one of the remaining two opposite to each other situated holes 18, 21 is of a seventh diameter and surrounded by a first sealing area 8 in the mentioned first plane as well as a second sealing area 30 circumferentially outside the first one and in the mentioned second plane.

The sealing areas have a special design in such a way that every second sealing area 8 around a port hole 17, 20 of the sixth diameter is created in one piece with the first sealing area 8 around the nearest in the plate situated port hole 18, 21 of the seventh diameter, these two sealing areas 8, on the second side of the plate beyond the plate in the FIG. 3, together create a distribution area 8 for heat exchanging fluid. Every third sealing area 30 around a port hole of the sixth diameter is further on designed in one piece with the second sealing area 30 around the closest in the plate situated port hole of the seventh diameter.

Every first sealing area 39 around a port hole 17, 20 of the sixth diameter shows a radial groove 9 which makes it possible for a heat exchanging fluid to pass from the port hole/port channel 17, 20 to the distribution area 8. Every first sealing area 8 around a port hole 18, 21 of the seventh diameter likewise shows a radial groove 10 which for one of the port holes 18, 21 of the seventh diameter in the plate makes it possible for a heat exchanging fluid to pass from the distribution area 8 to the backside of the sealing area 30 and from there further on out over the plate, i.e. one of the two grooves 10 on every plate is "open" while the other one is "closed".

On the described plate of the first form of execution there can further be found two third, mainly circular port holes 28, 29 situated straight opposite to each other and of an eighth diameter and each one surrounded by a first sealing area in the mentioned first plane.

Plates 32 of the second form of execution differs from plates 31 of the first form of execution in the following manner:

The two first, mainly circular port holes, situated opposite to each other, have changed places in the plate. Moreover all sealing areas have changed planes either from the first plane to the second or from the said second plane to the said first one.

Regarding the four second, pairwise opposite to each other in the plate situated, circular port holes all present sealing areas have changed planes from the said first plane to the said second one or vice versa.

Regarding the two third, straight opposite to each other situated, circular port holes each one is surrounded by a sealing area in the mentioned second plane.

The corrugations are oriented in another way.

Plates 33 of the third form of execution show, compared to plates 31 of the first form of execution, the following differences:

The two first, mainly circular port holes situated opposite to each other in the plate, have changed places in the plate.

Plates 34 of the fourth form of execution show, compared to plates 31 of the first form of execution, the following differences:

All sealing areas have changed planes either from the said first plane to the said second one or vice versa. The corrugations are oriented in another way.

Figure 5A:
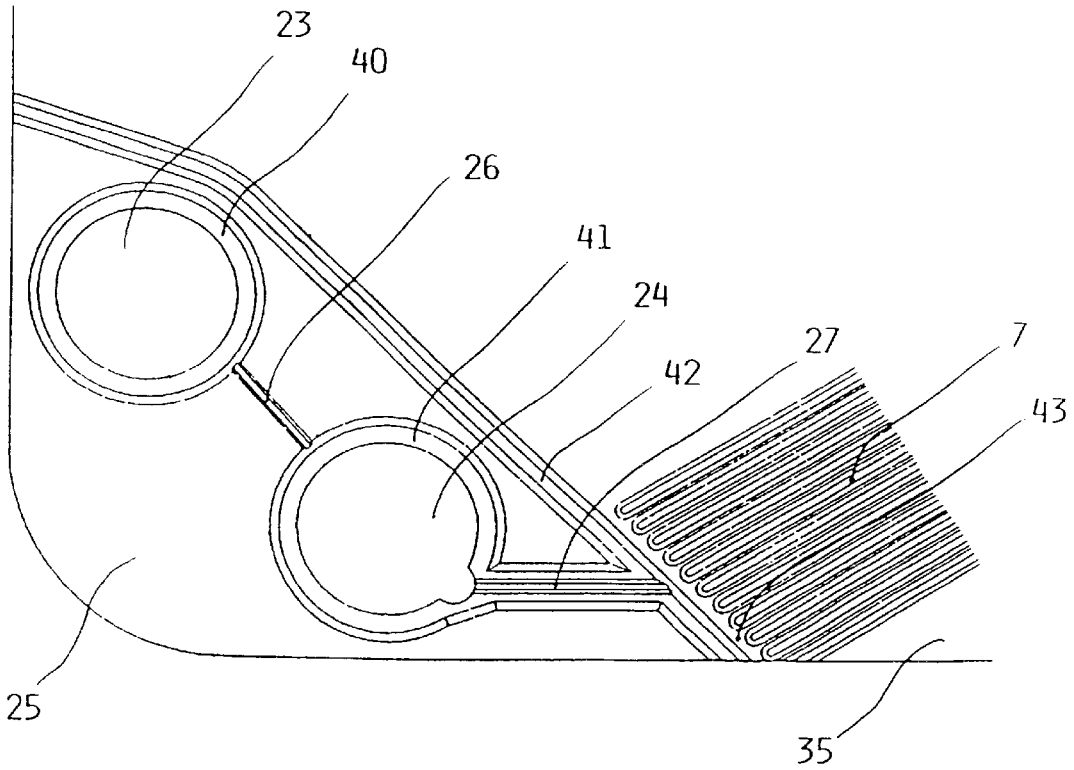
FIG. 5*a* shows in front view and in principal a part of (a corner of) an alternative form of execution of a heat exchanging plate for refrigeration applications.
Figure 5B:
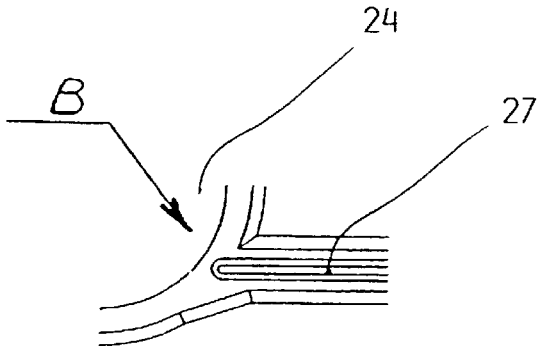
FIG. 5*b* shows a part of the plate corner in FIG. 5*a* before the cutting up of the inlet channel.

In the plate package with plates according to FIG. 5*a*, compared to plates according to the FIGS. 3 and 4, the distribution area 8 has been replaced by recesses 26, 27 in combination with a drained area 25, whereby refrigerant entering through the port hole/channel 23 flows to the port hole/channel 24 via the recess 26 and is distributed over plates in suitable plate interspaces via the recesses 27. Only those of the recesses 27 aimed at distributing refrigerant are in fluid communication with the port hole/channel 24, the others are "closed", see the detail B in FIG. 5*b*. The recesses 27 may be pressed "closed" at pressing of the plate and where so is needed be opened later on in connection with the putting together of the heat exchanger. Also several recesses 27 may be present in parallel on every plate between the port hole/channel 24 and the heat exchanging part of the plate interspace, for example of different length and cross-sectional area in order to suit different refrigerants in terms of fall of pressure, only those that are most convenient for the application thought of being open. Only one corner of a plate is shown in FIG. 5*a* whereby it shall be understood that an opposite corner has the same appearance but in mirror inversion and thus as a counterpart to the port hole 23 shows the port hole 23' and as a counterpart to the port hole 24 shows the port hole 24'.

Plates 35 of the first form of execution according to FIG. 5*a* thus show in conformity with plates 31 two first, mainly circular port holes 19, 22, situated opposite to each other in the plate and along the same side edge, of which the one port hole 19 is of a fourth diameter and is surrounded by a sealing area in the mentioned second plane. The second port hole 22 is of a fifth diameter and is surrounded by an inner sealing area in the mentioned first plane and a circumferentially outside the inner one situated outer sealing area in the mentioned second plane. The fifth diameter is smaller than the fourth one.

Plates 35 further show four second, mainly circular port holes 23, 23', 24, 24', pairwise situated opposite to each other in the plate and along the same side edge, where two of the opposite to each other situated holes 23, 23' each one is of a sixth diameter and surrounded by a first sealing area 40 in the mentioned second plane as well as a second sealing area 25 circumferentially situated outside the first one and in the mentioned first plane. The remaining two, opposite to each other situated holes 24, 24' each one is of a seventh diameter and surrounded by a first sealing area 41 in the mentioned second plane as well as a second sealing area 25 circumferentially situated outside the first one and in the mentioned first plane. Still another sealing area 42 in the mentioned second plane and a sealing area 43 in the mentioned first plane divide each one of the other sealing areas 25 from the corrugations of the plate, whereby the sealing area 43 extends between the sealing area 42 and the corrugations.

Every second sealing area 25 around a port hole of the sixth diameter is created in one piece with the second sealing area 25 around the closest in the plate situated port hole of the seventh diameter and where every such in one piece created sealing area 25 shows two in relation to the port holes mainly radial recesses 26, 27 where the one recess 26 connects a port hole 23 of the sixth diameter with the closest situated port hole 24 of the seventh diameter, making possible for a heat exchanging fluid to pass between the port holes 23 and 24. The second groove 27 at one of the port holes 24 of the seventh diameter in the plate makes it possible for the fluid also to pass the further sealing area 42 and flow out over the corrugations of the plate.

Like in the plates 31 there are further to be found two third, mainly circular port holes 28, 29 situated straight opposite to each other. The holes are of an eighth diameter and each one surrounded by a first sealing area in the mentioned first plane.

Plates 36 of the second form of execution differ from plates 35 of the first form of execution in the following manner:

The two first circular port holes 19, 22 situated opposite to each other have changed places in the plate. Moreover all sealing areas on the plate have changed planes either from the said first to the said second plane or vice versa. The corrugations are oriented in another way.

Plates 37 of the third form of execution show in comparison with plates 35 of the first form of execution the following differences:

The two first circular port holes situated opposite to each other have changed places in the plate.

Plates 38 of the fourth form of execution show in comparison with plates 35 of the first form of execution the following differences:

All the sealing areas have changed planes either from the said first to the said second plane or vice versa. The corrugations are oriented in another way.

The mentioned fifth diameter may be of the same size as the mentioned eighth diameter. The mentioned sixth diameter may be of the same size as the mentioned seventh diameter.

All the plate types may, after minor modifications, also be used in plate heat exchangers where the fluids are aimed at flowing mainly in parallel with two of the side edges of the plates. This is especially true for the plates according to the FIGS. 3–5 since the diameters of the port holes according to the example of execution are suited just as well for flow in parallel as for diagonal flow. The planes of the sealing areas must on the contrary be varied in a suitable manner.

Each one of all the heat exchanging plates irrespective of the type or form of execution may be created with a flange-like edge around the whole circumference of the plate, which edge makes an angle with the main plane of extension of the plate and which bears on the corresponding edges on adjacent plates in the core of plates. On each other bearing surfaces in the core of plates, for example the newly mentioned flange-like edges, may be fluid tightly joined for example by brazing.

The plates are often created in thin steel plate, but also other materials are possible such as titanium, ceramic materials etc.

The described invention in an elegant manner combines an effective heat transfer in using the principle of diagonal flow and/or several inlet channels for the heat regulating fluids on one side and the possibility of a flexible part load regulation of the plate heat exchanger due to the presence of three fluids on the other hand. The heat regulated fluid is in all its plate interspaces in contact with both the heat regulating fluids. In connection with deliberate drawdown of the effect of the heat exchanger by cutting down or cuffing off of the delivery of one of the heat regulating fluids to the heat exchanger there remains in every plate interspace a contact between the heat regulating fluid which is not cut down and the fluid which is to be effected. The fact that this remaining effect is effective is guaranteed by the fact that the heat regulating fluid which is not cut down flows diagonally over the plate and thus is spread effectively over the whole width of the plate, which becomes more important with a larger width of the heat transferring plate, and/or that the unaffected fluid is uniformly distributed over all plate interspaces in question by being forced to pass through several inlet channels.

It is possible to think of a plate heat exchanger without thicker end plates 5. The core of the plates may thereby instead be completed by a pressed heat exchanging plate in both ends, whereby the plate in one end of the core of plates may be totally out of holes.

With the aim to simplify the manufacturing of the plates it is possible for example for the forms of execution of the plates in FIG. 2, to press the plates of only two types where the four port holes in the corners of the plate 13, 14, 15, 16 all are executed with the same diameter and those port holes that ought to be larger when the heat exchanger is built up are cut or punched afterwards and only to a certain extent, for example within a sector of a sealing area running around the hole.

Further on it is possible to think of using plates according to the invention in a simplified way in plate heat exchangers for only two fluids. Thereby one may for example just use plates of the first and second forms of execution according to FIG. 2. It is also possible to totally close the inlet to one refrigerant channel and at the same time unite two outlet channels.

The invention is not restricted to the forms of execution shown here but may be varied in accordance with the following patent claims.

What is claimed is:

1. A plate heat exchanger for refrigeration applications for three heat exchanging fluids which heat exchanger comprises at least one core of plates with heat exchanging plates (31–38), at least two end plates (5) and inlets and outlets (6) for the heat exchanging fluids, the heat exchanging plates being provided with port holes (17–23, 23', 24, 24', 28, 29) creating inlet channels and outlet channels through the core of plates for the fluids, the channels for one fluid being in fluid communication with every other plate interspace and the channels for each one of the remaining two fluids being in alternating fluid communication with every other of the remaining plate interspaces and the heat exchanging plates (31–38) are each provided with one or several corrugations (7) vertically extending within an area restricted by two parallel first and second planes respectively at a distance to each other together creating the thickness restriction of the plate and both substantially in parallel with all the plates (31–38) in the core of plates as well as with the end plates (5) of the plate heat exchanger whereby the first plane is closer to a first end plate (5) in one end of the heat exchanger than the second plane is and the second plane is closer to a second end plate (5) in the other end of the heat exchanger than the first plane is, wherein the heat exchanging plates (31–38) are present in four different forms of execution alternating within the core of plates in such a way that a plate (31, 35) of a first form of execution is mounted close to a plate (32, 36) of a second form of execution and a plate (34, 38) of a fourth form of execution, a plate (32, 36) of the second form of execution is mounted close to a plate (33, 37) of a third form of execution and a plate (31, 35) of the first form of execution, a plate (33, 37) of the third form of execution is mounted close to a plate (34, 38) of the fourth form of execution and a plate (32, 36) of the second form of execution and a plate (34, 38) of the fourth form of execution is mounted close to a plate (31, 35) of the first form of execution and a plate (33, 37) of the third form of execution and the port holes (17, 18, 20, 21, 23, 23', 24, 24') for each one of the two remaining fluids create at least two inlet channels through the core of plates which, for each one of the fluids, are in fluid communication with each other at a plurality of places along the inlet channels in such a way that the fluid, on its way from one inlet channel to plate interspaces aimed therefore, is forced to flow through another inlet channel.

2. A plate heat exchanger according to claim 1 at which plates (31) of the first form of execution have two first substantially circular port holes (19, 22) situated opposite to each other of which one port hole (19) is of a fourth diameter and surrounded by a sealing area in the second plane and the other port hole (22) is of a fifth diameter and surrounded by an inner sealing area in the first plane and an outer sealing area circumferentially outside the inner sealing area in the second plane, whereby the fifth diameter is smaller than the fourth diameter, four second substantially circular port holes (17, 18; 20, 21) situated as opposing pairs of holes where one hole of each pair of holes (17, 20) is of a sixth diameter and surrounded by a first sealing area (39) in the second plane, a second sealing area (8) circumferentially outside the first sealing area and in the first plane as well as a third sealing area (30) circumferentially outside the second sealing area and in the second plane and where the remaining hole of each pair of holes (18, 21) is of a seventh diameter and surrounded by a first sealing area (8) in the first plane as well as a second sealing area (30) circumferentially outside the first sealing area and in the second plane and where every second sealing area (8) around a port hole (17, 20) of the sixth diameter is created in one piece with the first sealing area (8) around the closest port hole (18, 21) of the seventh diameter situated thereto in the plate (31) whereby said two sealing areas (8) together constitute a distribution area (8) for heat exchanging fluid and where every third sealing area (30) around a port hole (17, 20) of the sixth diameter is crated in one piece with the second sealing area (30) around the port hole (18, 21) of the seventh diameter situated closest thereto in the plate (31) and where every first sealing area (39) around a port hole (17, 20) of the sixth diameter has a radial groove (9) making it possible for a heat exchanging fluid to pass from the port hole (17, 20) to the distribution area (8) and where every first sealing area (8) around a port hole (18, 21) of the seventh diameter likewise has a radial groove (10) which for one of the port holes (18, 21) of the seventh diameter in the plate (31) makes it possible for a heat exchanging fluid to pass from the distribution area (8) to a backside of the sealing area (30) and from there further on out over the plate (31) and two third substantially circular port holes (28, 29) situated opposite to each other and being of an eighth diameter and each one surrounded by a first sealing area in the first plane.

3. A plate heat exchanger according to claim 1 at which plates (32) of the second form of execution have two first substantially circular port holes (19, 22) situated opposite to each other of which one port hole (19) is of a fifth diameter and is surrounded by an inner sealing area in the second plane as well as an outer sealing area circumferentially outside the inner sealing area in the first plane and the other port hole (22) is of a fourth diameter and is surrounded by a sealing area in the first plane, the fourth diameter being larger than the fifth diameter, four second substantially circular port holes (17, 18; 20, 21) situated as opposing pairs of holes where one hole of each pair of holes (17, 20) is of a sixth diameter and surrounded by a first sealing area (39) in the first plane, a second sealing area (8) circumferentially outside the first sealing area and in the second plane, as well as a third sealing area (30) circumferentially outside the second sealing area and in the first plane and where the remaining hole of each pair of holes is of a seventh diameter and surrounded by a first sealing area (8) in the second plane as well as a second sealing area (30) circumferentially outside the first sealing area and in the first plane and where every second sealing area (8) around a port hole of the sixth diameter is created in one piece with the first sealing area (8) around the closest port hole (18, 21) of the seventh diameter situated thereto in the plate (32) whereby said two sealing areas (8) together constitute a distribution area (8) for heat exchanging fluid and where every third sealing area (30) around a port hole (17, 20) of the sixth diameter is created in one piece with the second sealing area (30) around the port hole (18, 21) of the seventh diameter situated. closest thereto in the plate (32) and where every first sealing area (39) around a port hole (17, 20) of the sixth diameter has a radial groove (9) making it possible for a heat exchanging fluid to pass from the port hole (17, 20) to the distribution area (8) and where every first sealing area (8) around a port hole (18, 21) of the seventh diameter likewise has a radial groove (10) which for one of the port holes (18, 21) of the seventh diameter in the plate (32) makes it possible for a heat exchanging fluid to pass from the distribution area (8) to a backside of the sealing area (30) and from there further on out over the plate (32) and two third substantially circular port holes (28, 29) of an eighth diameter and being situated opposite to each other and each one surrounded by a first sealing area in the second plane.

4. A plate heat exchanger according to claim 1 at which plates (33) of the third form of execution have two first substantially circular port holes (19, 22) situated opposite to each other of which one port hole (19) is of a fifth diameter and surrounded by an inner sealing area in the first plane as well as an outer sealing area circumferentially outside the inner sealing area in the second plane and the other port hole (22) is of a fourth diameter and surrounded by a sealing area in the second plane, the fourth diameter being larger than the fifth diameter, four second substantially circular port holes (17, 18; 20, 21) situated as opposing pairs of holes where one hole of each pair of holes (17, 20) is of a sixth diameter and surrounded by a first sealing area (39) in the second plane, a second sealing area (8) circumferentially outside the first sealing area and in the first plane as well as a third sealing area (30) circumferentially outside the second sealing area and in the second plane and where the remaining hole of each pair of holes is of a seventh diameter and surrounded by a first sealing area (8) in the first plane as well as a second sealing area (30) circumferentially outside the first sealing area and in the second plane and where every second sealing area (8) around a port hole (17, 20) of the sixth diameter is created in one piece with the first sealing area (8) around the port hole (18, 21) of the seventh diameter situated closest thereto in the plate (33) whereby said two sealing areas (8) together constitute a distribution area (8) for heat exchanging fluid and where every third sealing area (30) around a port hole (17, 20) of the sixth diameter is created in one piece with the second sealing area (30) around the closest situated port hole (18, 21) of the seventh diameter in the plate (33) and where every first sealing area (39) around a port hole (17, 20) of the sixth diameter has a radial groove (9) making it possible for a heat exchanging fluid to pass from the port hole (17,

20) to the distribution area (8) and where every first sealing area (8) around a port hole (18, 21) of the seventh diameter likewise has a radial groove (10) which for one of the port holes (18, 21) of the seventh diameter in the plate (33) makes it possible for a heat exchanging fluid to pass from the first distribution area (8) to a backside of the sealing area (30) and from there further on out over the plate (33) and two third substantially circular port holes (28, 29) of an eighth diameter situated opposite to each other and each one surrounded by a first sealing area in the first plane.

5. A plate heat exchanger according to claim 1 at which plates (34) of the fourth form of execution have two first substantially circular port holes (19, 22) situated opposite to each other of which one port hole (19) is of a fourth diameter and surrounded by a sealing area in the first plane and the other port hole (22) is of a fifth diameter and surrounded by an inner sealing area in the second plane as well as an outer sealing area circumferentially outside the inner sealing area in the first plane, the fifth diameter being smaller than the fourth diameter, four second substantially circular port holes (17, 18; 20, 21) situated as opposing pairs of holes where one hole of each pair of holes (17, 20) is of a sixth diameter and surrounded by a first sealing area (39) in the first plane, a second sealing area (8) circumferentially outside the first sealing area and in the second plane as well as a third sealing area (30) circumferentially outside the second sealing area and in the first plane and where the remaining hole of each pair of holes (18, 21) is of a seventh diameter and surrounded by a first sealing area (8) in the second plane as well as a second sealing area (30) circumferentially outside the first sealing area and in the first plane and where every second sealing area (8) around a port hole (17, 20) of the sixth diameter is created in one piece with the first sealing area (8) around the closest port hole (18, 21) of the seventh diameter situated thereto in the plate (34), whereby said two sealing areas (8) together constitute a distribution area (8) for heat exchanging fluid and where every third sealing area (30) around a port hole (17, 20) of the sixth diameter is created in one piece with the second sealing area (30) around the port hole (18, 21) of the seventh diameter situated closest thereto in the plate and where every first sealing area (39) around a port hole (17, 20) of the sixth diameter has a radial groove (9) making it possible for a heat exchanging fluid to pass from the port hole (17, 20) to the distribution area (8) and where every first sealing area (8) around a port hole (18, 21) of the seventh diameter likewise has a radial groove (10) which for one of the port holes (18, 21) of the seventh diameter in the plate (34) makes it possible for a heat exchanging fluid to pass from the distribution area (8) to a backside of the sealing area (30) and from there further on out over the plate (34) and two third substantially circular port holes (28, 29) of an eighth diameter and being situated opposite to each other and each one surrounded by a first sealing area in the second plane.

6. A plate heat exchanger according to claim 1 at which plates (35) of the first form of execution have two first substantially circular portholes (19, 22) situated opposite to each other of which one port hole (19) is of a fourth diameter and surrounded by a sealing area in the second plane and the other port hole (22) is of a fifth diameter and surrounded by an inner sealing area in the first plane and an outer sealing area circumferentially outside the inner sealing area in the second plane, the fifth diameter being smaller than the fourth diameter, four second substantially circular port holes (23, 23', 24, 24') situated as opposing pairs of holes where one hole of each pair of holes (23, 23') is of a sixth diameter and surrounded by a first sealing area (40) in the second plane as well as a second sealing area (25) circumferentially outside the first sealing area and in the first plane and where the remaining hole of each pair of holes (24, 24') is of a seventh diameter and surrounded by a first sealing area (41) in the second plane as well as a second sealing area (25) circumferentially outside the first sealing area and in the first plane and where a further sealing area (42) in the second plane and a sealing area (43) in the first plane divide each one of the second sealing areas (25) from the corrugations (7) of the plate and where every second sealing area (25) around a port hole (23, 23') of the sixth diameter is created in one piece with the second sealing area (25) around the port hole (24, 24') of the seventh diameter situated closest thereto in the plate and where every said one piece sealing area (25) has two in relation to the port holes (23, 23', 24, 24') substantially radial grooves (26, 27) where one groove (26) connects a port hole (23, 23') of the sixth diameter with the closest situation port hole (24, 24') of the seventh diameter making it possible for a heat exchanging fluid to pass between the port holes (23, 23', 24, 24') and where the other groove (27) at one of the port holes (24, 24') of the seventh diameter in the plate (35) makes it possible for the fluid to pass the further sealing area (42) and flow out over the corrugations (7) of the plate (35) and two third substantially circular port holes (28, 29) of an eighth diameter and being situated opposite to each other and each one surrounded by a first sealing area in the first plane.

7. A plate heat exchanger according to claim 1 or claim 6 at which plates (36) of the second form of execution have two first substantially circular port holes (19, 22) situated opposite to each other of which one port hole (19) is of a fifth diameter and surrounded by an inner sealing area in the second plane as well as an outer sealing area circumferentially outside the inner sealing area in the first plane and the other port hole (22) is of fourth diameter and surrounded by a sealing area in the first plane, the fourth diameter being larger than the fifth diameter, four second substantially circular port holes (23, 23', 24, 24') situated as opposing pairs of holes where one hole of each pair of holes (23, 23') is of a sixth diameter and surrounded by a first sealing area (40) in the first plane as well as a second sealing area (25) circumferentially outside the first sealing area and in the second plane and where the remaining hole of each pair of holes is of a seventh diameter and surrounded by a first sealing area (41) in the first plane as well as a second sealing area (25) circumferentially outside the first sealing area and in the second plane and where a further sealing area (42) in the first plane and a sealing area (43) in the second plane divide each one of the second sealing areas (25) from the corrugations (7) of the plate and where every second sealing area (25) around a port hole (23, 23') of the sixth diameter is created in one piece with the second sealing area (25) around the closest port hole (24, 24') of the seventh diameter situated thereto in the plate and where every said one piece sealing area (25) has two in relation to the port holes (23, 23', 24, 24') substantially radial grooves (26, 27) where one groove (26) connects a port hole (23, 23') of the sixth diameter with the closest situated port hole (24, 24') of the seventh diameter making it possible for a heat exchanging fluid to pass between the port holes (23, 23', 24, 24') and where the other groove (27) at one of the port holes (24, 24') of the seventh diameter in the plate (36) makes it possible for the fluid to pass the further sealing area (42) and flow out over the corrugations (7) of the plate (36) and two third substantially circular port holes (28, 29) of an eighth diameter situated opposite to each other and each one surrounded by a first sealing area in the second plane.

8. A plate heat exchanger according to claim 1 or claim 6 at which plates (37) of the third form of execution have two first substantially circular port holes (19, 22) situated opposite to each other of which one port hole (19) is of a fifth diameter and surrounded by an inner sealing area in the first plane as well as an outer sealing area circumferentially outside the inner sealing area in the second plane and the other port hole (22) is of a fourth diameter and surrounded by a sealing area in the second plane, the fourth diameter being larger than the fifth diameter, four second substantially circular port holes (23, 23', 24, 24') situated as opposing pairs of holes where one hole of each pair of holes (23, 23') is of a sixth diameter and surrounded by a first sealing area (40) in the second plane as well as a second sealing area (25) circumferentially outside the first sealing area and in the first plane and where the remaining hole of each pair of holes is of a seventh diameter and surrounded by a first sealing area (41) in the second plane as well as a second sealing area (25) circumferentially outside the first sealing area and in the first plane and where a further sealing area (42) in the second plane and a sealing area (43) in the first plane divide each one of the second sealing areas (25) from the corrugations (7) of the plate and where every second sealing area (25) around a port hole (23, 23') of the sixth diameter is created in one piece with the second sealing area (25) around the closest port hole (24, 24') of the seventh diameter situated thereto in the plate and where every said one piece sealing area (25) has two in relation to the port holes (23, 23', 24, 24') substantially radial grooves (26, 27) where one groove (26) connects a port hole (23, 23') of the sixth diameter with the closest situated port hole (24, 24') of the seventh diameter making it possible for a heat exchanging fluid to pass between the port holes (23, 23', 24, 24') and where the other groove (27) at one of the port holes (24, 24') of the seventh diameter in the plate (37) makes it possible for the fluid to pass the further sealing area (42) and flow out over the corrugations (7) of the plate (37) and two third substantially circular port holes (28, 29) of an eighth diameter situated opposite to each other and each one surrounded by a first sealing area in the first plane.

9. A plate heat exchanger according to claim 1 or claim 6 at which plates (38) of the fourth form of execution have two first substantially circular port holes (19, 22) situated opposite to each other of which one port hole (19) is of a fourth diameter and surrounded by a sealing area in the first plane and the other port hole (22) is of a fifth diameter and surrounded by an inner sealing area in the second plane as well as an outer sealing area circumferentially outside the inner sealing area in the first plane, the fifth diameter being smaller than the fourth diameter, four second substantially circular port holes (23, 23', 24, 24') situated as opposing pairs of holes where one hole of each pair of holes (23, 23') is of a sixth diameter and surrounded by a first sealing area (40) in the first plane as well as a second sealing area (25) circumferentially outside the first sealing area and in the second plane and where the remaining hole of each pair of holes is of a seventh diameter and surrounded by a first sealing area (41) in the first plane as well as a second sealing area (25) circumferentially outside the first sealing area and in the second plane and where a further sealing area (42) in the first plane and a sealing area (43) in the second plane divide each one of the second sealing areas (25) from the corrugations (7) of the plate and where every second sealing area (25) around a port hole (23, 23') of the sixth diameter is created in one piece with the second sealing area (25) around the closest port hole (24, 24') of the seventh diameter situated thereto in the plate and where every said one piece sealing area (25) has two in relation to the port holes (23, 23', 24, 24') substantially radial grooves (26, 27) where one groove (26) connects a port hole (23, 23') of the sixth diameter with the closest situated port hole (24, 24') of the seventh diameter making it possible for a heat exchanging fluid to pass between the port holes (23, 23', 24, 24') and where the other groove (27) at one of the port holes (24, 24') of the seventh diameter in the plate (38) makes it possible for the fluid to pass the further sealing area (42) and flow out over the corrugations (7) of the plate (38) and two third substantially circular port holes (28, 29) of an eighth diameter situated opposite to each other and each one surrounded by a first sealing area in the second plane.

10. A plate heat exchanger according to claim 2 or claim 6 in which the fifth diameter is of the same size as the eighth diameter.

11. A plate heat exchanger according to claim 6 in which the sixth diameter is of the same size as the seventh diameter.

12. A plate heat exchanger according to claim 1 or claim 6 in which the heat exchanging plates (1–4, 31–38) are substantially rectangular or square and every plate (1–4, 31–38) has three port holes (11, 14, 16, 19, 22, 28) along a first side edge and at least three port holes (12, 13, 15, 17, 18, 20, 21, 23, 24, 29) along a second side edge opposite to the first side edge.

13. A plate heat exchanger according to claim 1 or claim 6 in which each one of the heat exchanging plates (1–4, 31–38) is created with a flangelike edge running along the whole circumference of the plate, said edge making an angle with the main plane of extension of the plate and bearing on the corresponding edges on the adjacent plates in the core of plates.

14. A plate heat exchanger according to claim 1 or claim 6 in which surfaces contacting each other in the core of plates are tightly joined to prevent fluid leakage.

15. A plate heat exchanger according to claim 14 in which surfaces contacting each other in the core of plates are tightly joined by brazing.

* * * * *